US010570495B2

(12) United States Patent
Wang et al.

(10) Patent No.: US 10,570,495 B2
(45) Date of Patent: Feb. 25, 2020

(54) SURFACE LAYER FOR FAST DIFFUSION AND METHOD TO PRODUCE THEREOF

(71) Applicant: GM Global Technology Operations LLC, Detroit, MI (US)

(72) Inventors: Jeff Wang, Jiangsu (CN); Xiaochuan Xiong, Shanghia (CN)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 160 days.

(21) Appl. No.: 15/563,716

(22) PCT Filed: Apr. 8, 2015

(86) PCT No.: PCT/US2015/024822
§ 371 (c)(1),
(2) Date: Oct. 2, 2017

(87) PCT Pub. No.: WO2016/164003
PCT Pub. Date: Oct. 13, 2016

(65) Prior Publication Data

US 2018/0073122 A1 Mar. 15, 2018

(51) Int. Cl.
*C23C 8/02* (2006.01)
*C23C 8/32* (2006.01)
*C21D 10/00* (2006.01)

(52) U.S. Cl.
CPC ..... *C23C 8/02* (2013.01); *C21D 10/005* (2013.01); *C23C 8/32* (2013.01)

(58) Field of Classification Search
CPC ..... C23C 8/02; C23C 8/32; C21D 10/005
See application file for complete search history.

(56) References Cited

U.S. PATENT DOCUMENTS 6,153,023 A 11/2000 Rokutanda et al.
2008/0000550 A1 1/2008 Holly et al.
2011/0220415 A1 9/2011 Jin et al.

FOREIGN PATENT DOCUMENTS

CN 103046058 A 4/2013

OTHER PUBLICATIONS

B.K. Pant, V. Arya, and B.S. Mann, Cavitation Erosion Characteristics of Nitrocarburised and HPDL Treated Martensitic Stainless Steels, J. Mater. Eng. Perform., 2012, 21(6), p. 1051-1055.*
Improvement of wear resistance by laser shock processing and carburization composition technology used on 12crNi3A steel, Li Jing, et al. vol. 26, No. 5 dated May, 2014.

* cited by examiner

*Primary Examiner* — Jessee R Roe

(57) ABSTRACT

A number of variations may include a method that may include laser shock peening a friction work surface of a working part and applying a ferritic nitrocarburizing process to the friction work surface such that diffusion of carbon and nitrogen atoms into the friction work surface is accelerated.

21 Claims, 1 Drawing Sheet

SURFACE LAYER FOR FAST DIFFUSION AND METHOD TO PRODUCE THEREOF

TECHNICAL FIELD

The field to which the disclosure generally relates includes ferritic nitrocarburizing processes.

BACKGROUND

Ferritic nitrocarburizing processes utilize a furnace treatment for a predetermined amount of time in order to diffuse carbon and nitrogen into the surface of a part. Preparing the surface of a part prior to heat treatment may increase or decrease the diffusion rate on the surface of the part.

SUMMARY OF ILLUSTRATIVE VARIATIONS

A number of variations may include a method that may include laser shock peening a friction work surface of a working part and may include applying a ferritic nitrocarburizing process to the friction work surface such that diffusion of carbon and nitrogen atoms into the friction work surface may be accelerated.

A number of variations may include a method that may include machining a friction work surface of a working part; laser shock peening the friction work surface; and applying a ferritic nitrocarburizing process to the friction work surface such that diffusion of carbon and nitrogen atoms into the friction work surface may be accelerated.

A number of variations may include a method that may include applying a stress relief treatment to the working part at a temperature ranging from about 610° C. for 3 hours; machining a friction work surface of a working part; laser shock peening the friction work surface utilizing a high power density laser having a power of about 1 GW/cm$^2$ including a pulse energy of about 3 Joules, pulse duration of about 20 nanoseconds, and a laser beam diameter of about 3 mm; and applying a ferritic nitrocarburizing process to the friction work surface such that diffusion of carbon and nitrogen atoms into the friction work surface may be accelerated.

A number of variations may include a method that may include machining a friction work surface of a working part; laser shock peening the friction work surface utilizing a high power density laser having a power greater than or equal to 1 GW/cm$^2$ including a pulse energy of about 3 Joules, pulse duration of about 20 nanoseconds, and a laser beam diameter of about 3 mm; and applying a ferritic nitrocarburizing process for about 8 to about 12 hours at about 465° C. to about 495° C. to the friction work surface such that diffusion of carbon and nitrogen atoms into the friction work surface may be accelerated.

A number of variations may include a product that may include a part that may include a friction working surface that has been cast, undergone a stress relief process at about 610° C. for about 3 hours, machined, and a laser shock peened amorphous layer disposed on the friction working surface wherein the amorphous layer ranges from about 5 microns to about 500 microns in depth.

A number of variations may include a product that may include a part that may include a friction working surface that has been cast, machined, laser shock peened, and treated with a ferritic nitrocarburizing process ranging from about 555° C. to about 585° C. for about 1 to about 3 hours and an amorphous layer disposed on the friction working surface wherein the amorphous layer ranges from about 5 microns to about 500 microns in depth.

Other illustrative variations within the scope of the invention will become apparent from the detailed description provided hereinafter. It should be understood that the detailed description and enumerated variations, while disclosing optional variations, are intended for purposes of illustration only and are not intended to limit the scope of the invention.

BRIEF DESCRIPTION OF THE DRAWINGS

Select examples of variations within the scope of the invention will become more fully understood from the detailed description and the accompanying drawings, wherein.

DETAILED DESCRIPTION OF ILLUSTRATIVE VARIATIONS

The following description of the variations is merely illustrative in nature and is in no way intended to limit the scope of the invention, its application, or uses. The following description of variants is only illustrative of components, elements, acts, methods, and methods considered to be within the scope of the invention and are not in any way intended to limit such scope by what is specifically disclosed or not expressly set forth. The components, elements, acts, methods, and methods as described herein may be combined and rearranged other than as expressly described herein and still are considered to be within the scope of the invention.

A working part, such as a brake disc or drum brake, may have a friction working surface. The working part may include cast iron. The friction working surface may undergo a ferritic nitrocarburizing process involving a heat treatment step for a predetermined amount of time. Prior to undergoing the ferritic nitrocarburizing process, the friction working surface may undergo a surface treatment such as machining, shot peening, or cold working. Alternatively, the friction working surface may undergo a laser shock peening or laser shock peening process to form a nanocrystalline layer or amorphous layer on the surface of the working part. A nanocrystalline layer may have grain sizes ranging from about 5 nm to about 1000 nm. An amorphous layer may have an amorphous structure. The nanocrystalline layer or amorphous layer may range from about 5 to about 500 microns in depth.

The laser shock peening process may utilize a laser having a pulse energy of 3 Joules and a pulse duration of 20 nanoseconds. The diameter of the laser beam may be about 3 millimeters. The scan frequency of the laser shock peening process may be about 2 Hz.

After the laser shock peening process, the working part may undergo a ferritic nitrocarburizing process at a temperature ranging from about 570° C. to about 580° C. for about 1 to about 3 hours or from about 465° C. to about 495° C. for about 2-10 hours to achieve a compound layer about 10 microns in depth.

One process may include casting an iron brake drum or disk, stress relieving the brake at 610° C. for 3 or more hours, machining the friction working surface of the brake, laser shock peening the friction working surface, and nitrocarburizing the brake at 570° C. for about 1 hour or at a temperature ranging from about 555° C. to about 585° C. for about 2-5 hours.

One process may include casting an iron brake drum or disk, machining the friction working surface of the brake, laser shock peening the friction working surface and nitrocarburizing the brake at 480° C. for about 8 to about 10 hours.

Figure 1:
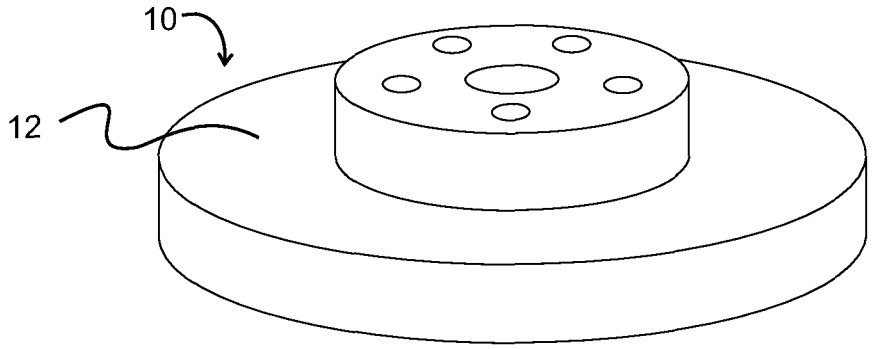
FIG. 1 depicts one variation of a cast iron brake rotor.
Figure 2:
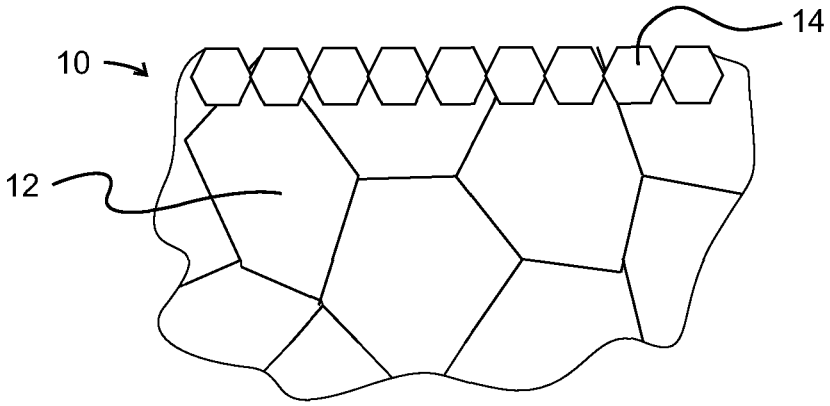
FIG. 2 depicts one variation of a part that may include a friction working surface.

Referring to FIGS. 1 & 2, a number of variations may include a product that may include a part 10 that may include a friction working surface 12 that has been cast, undergone a stress relief process at about 610° C. for about 3 hours, machined, and a laser shock peened amorphous layer 14 disposed on the friction working surface 12 wherein the amorphous layer 14 ranges from about 5 microns to about 500 microns in depth.

According to variation 1, a method may include laser shock peening a friction work surface of a working part and may include applying a ferritic nitrocarburizing process to the friction work surface such that diffusion of carbon and nitrogen atoms into the friction work surface is accelerated.

Variation 2 may include a method as set forth in variation 1 wherein the laser shock peening process may refine the microstructure of the friction work surface such that a nanocrystalline layer of about 5 to about 500 μm in depth is formed.

Variation 3 may include a method as set forth in variation 1 or 2 wherein the laser shock peening process refines the microstructure of the friction work surface such that an amorphous layer of less than or equal to about 500 μm in depth is formed.

Variation 4 may include a method as set forth in any of variations 1 through 3 wherein the laser shock peening process utilizes a high power density laser having a power ranging from about 0.5 $GW/cm^2$ to about 5 $GW/cm^2$.

Variation 5 may include a method as set forth in any of variations 1 through 4 wherein the ferritic nitrocarburizing process may include a furnace treatment for about 2-6 hours at about 555° C. to about 585° C.

Variation 6 may include a method as set forth in any of variations 1 through 5 wherein the ferritic nitrocarburizing process may include a furnace treatment for about 2-4 hours at about 570° C.-580° C.

Variation 7 may include a method as set forth in any of variations 1 through 6 wherein the laser shock peening process includes a pulse energy of about 3 Joules, pulse duration of about 20 nanoseconds, and a laser beam diameter of about 3 mm.

Variation 8 may include a method as set forth in any of variations 1 through 7 and may further include, prior to laser shock peening the friction work surface, applying a stress relief treatment to the working part at about 610° C. for about 2-4 hours.

Variation 9 may include a method as set forth in any of variations 1 through 8 further may include, prior to laser shock peening the friction work surface, machining the friction work surface.

According to variation 10, a method may include machining a friction work surface of a working part; laser shock peening the friction work surface; and applying a ferritic nitrocarburizing process to the friction work surface such that diffusion of carbon and nitrogen atoms into the friction work surface may be accelerated.

Variation 11 may include a method as set forth in variation 10 wherein the ferritic nitrocarburizing process may include a furnace treatment for about 8 to about 12 hours at about 455° C. to about 495° C.

Variation 12 may include a method as set forth in any of variations 10 through 11 wherein the laser shock peening process refines the microstructure of the friction work surface such that a nanocrystalline layer of about 5 to about 500 μm in depth is formed.

Variation 13 may include a method as set forth in any of variations 10 through 12 wherein the laser shock peening process refines the microstructure of the friction work surface such that an amorphous layer is formed.

Variation 14 may include a method as set forth in any of variations 10 through 13 wherein the laser shock peening process utilizes a high power density laser having a power ranging from about 0.5 $GW/cm^2$ to about 5 $GW/cm^2$.

Variation 15 may include a method as set forth in any of variations 10 through 14 wherein the laser shock peening process includes a pulse energy of about 3 Joules, pulse duration of about 20 nanoseconds, and a laser beam diameter of about 3 mm.

Variation 16 may include a method as set forth in any of variations 10 through 15 may further include, prior to laser shock peening the friction work surface, applying a stress relief treatment to the working part at about 610° C. for greater than or equal to about 3 hours.

According to variation 17, a method may include applying a stress relief treatment to the working part at about 610° C. for 3 hours; machining a friction work surface of a working part; laser shock peening the friction work surface utilizing a high power density laser having a power of about 1 $GW/cm^2$ including a pulse energy of about 3 Joules, pulse duration of about 20 nanoseconds, and a laser beam diameter of about 3 mm; and applying a ferritic nitrocarburizing process to the friction work surface such that diffusion of carbon and nitrogen atoms into the friction work surface may be accelerated.

Variation 18 may include a method as set forth in variation 17 wherein the ferritic nitrocarburizing process may include a furnace treatment ranging from about 1 to about 3 hours at about 555° C. to about 585° C.

Variation 19 may include a method as set forth in any of variations 17 through 18 wherein the ferritic nitrocarburizing process may include a furnace treatment ranging from about 8 to about 12 hours at about 465° C. to about 495° C.

According to variation 20, a method may include laser shock peening a friction work surface of a working part utilizing a high power density laser having a power greater than or equal to 1 $GW/cm^2$ including a pulse energy of about 3 Joules, pulse duration of about 20 nanoseconds, and a laser beam diameter of about 3 mm; and applying a ferritic nitrocarburizing process for about 8 to about 12 hours at about 465° C. to about 495° C. to the friction work surface such that diffusion of carbon and nitrogen atoms into the friction work surface may be accelerated.

According to variation 21, a product may include a part that may include a friction working surface that has been cast, undergone a stress relief process at about 610° C. for about 3 hours, machined, and a laser shock peened and an amorphous layer disposed on the friction working surface wherein the amorphous layer ranges from about 5 microns to about 500 microns in depth.

Variation 22 may include a product as set forth in variation 21 wherein the part is a cast iron brake rotor.

According to variation 23, a product may include a part may include a friction working surface that has been cast, machined, laser shock peened, and treated with a ferritic nitrocarburizing process at about 450° C. for about 2 to about 4 hours and an amorphous layer disposed on the friction working surface wherein the amorphous layer ranges from about 5 microns to about 500 microns in depth.

Variation 24 may include a product as set forth in variation 23 wherein the part is a cast iron brake rotor.

The above description of variations of the invention is merely demonstrative in nature and, thus, variations thereof are not to be regarded as a departure from the spirit and scope of the inventions disclosed within this document.

What is claimed is:

1. A method comprising:

laser shock peening a friction work surface of a working part; and applying a ferritic nitrocarburizing process to the friction work surface of the working part in order to facilitate diffusion of carbon and nitrogen atoms into the friction work surface of the working part.

2. The method according to claim 1 wherein the laser shock peening process refines the microstructure of the friction work surface of the working part such that a nanocrystalline layer of about 5 to about 500 μm in depth is formed.

3. The method according to claim 1 wherein the laser shock peening process refines the microstructure of the friction work surface of the working part such that an amorphous layer of less than or equal to about 500 μm in depth is formed.

4. The method according to claim 1 wherein the laser shock peening process utilizes a high power density laser having a power ranging from about 0.5 $GW/cm^2$ to about 5 $GW/cm^2$.

5. The method according to claim 1 wherein the ferritic nitrocarburizing process comprises a furnace treatment for about 2-6 hours at about 555° C. to about 585° C.

6. The method according to claim 1 wherein the ferritic nitrocarburizing process comprises a furnace treatment for about 2-4 hours at about 570° C.-580° C.

7. The method according to claim 1 wherein the laser shock peening process includes a pulse energy of about 3 Joules, pulse duration of about 20 nanoseconds, and a laser beam diameter of about 3 mm.

8. The method according to claim 1, further comprising, prior to laser shock peening the friction work surface, applying a stress relief treatment to the working part at about 610° C. for about 2-4 hours.

9. The method according to claim 1, further comprising, prior to laser shock peening the friction work surface of the working part, machining the friction work surface.

10. The method according to claim 1 wherein the laser shock peening process refines the microstructure of the friction work surface of the working part such that an amorphous layer is formed.

11. The method according to claim 1, further comprising, prior to laser shock peening the friction work surface of the working part, applying a stress relief treatment to the working part at about 610° C. for greater than or equal to about 3 hours.

12. A method comprising:

machining a friction work surface of a working part;

laser shock peening the friction work surface of the working part; and applying a ferritic nitrocarburizing process to the friction work surface of the working part in order to facilitate diffusion of carbon and nitrogen atoms into the friction work surface of the working part.

13. The method according to claim 12, wherein the ferritic nitrocarburizing process comprises a furnace treatment for about 8 to about 12 hours at about 455° C. to about 495° C.

14. A method comprising:

applying a stress relief treatment to a working part at about 610° C. for 3 hours;

machining a friction work surface of the working part;

laser shock peening the friction work surface of the working part utilizing a high power density laser having a power of about 1 $GW/cm^2$ including a pulse energy of about 3 Joules pulse duration of about 20 nanoseconds, and a laser beam diameter of about 3 mm; and applying a ferritic nitrocarburizing process to the friction work surface of the working part in order to facilitate such that diffusion of carbon and nitrogen atoms into the friction work surface of the working part.

15. The method according to claim 14 wherein the ferritic nitrocarburizing process comprises a furnace treatment ranging from about 1 to about 3 hours at about 555° C. to about 585° C.

16. The method according to claim 14 wherein the ferritic nitrocarburizing process comprises a furnace treatment ranging from about 8 to about 12 hours at about 465° C. to about 495° C.

17. A method comprising:

machining a friction work surface of a working part;

laser shock peening the friction work surface of the working part utilizing a high power density laser having a power greater than or equal to 1 $GW/cm^2$ including a pulse energy of about 3 Joules, pulse duration of about 20 nanoseconds, and a laser beam diameter of about 3 mm; and applying a ferritic nitrocarburizing process for about 8 to about 12 hours at about 465° C. to about 495° C. to the friction work surface of the working part in order to facilitate such that diffusion of carbon and nitrogen atoms into the friction work surface of the working part.

18. A product comprising:

a part comprising a friction working surface that has been cast, undergone a stress relief process at about 610° C. for about 3 hours, machined, and laser shock peened and an amorphous layer disposed on the friction working surface wherein the amorphous layer ranges from about 5 microns to about 500 microns in depth.

19. The product according to claim 18, wherein the part is a cast iron brake rotor.

20. A product comprising:

a part comprising a friction working surface that has been cast, machined, laser shock peened, and treated with a ferritic nitrocarburizing process at about 450° C. for about 2 to about 4 hours and an amorphous layer disposed on the friction working surface wherein the amorphous layer ranges from about 5 microns to about 500 microns in depth.

21. The product according to claim 20, wherein the part is a cast iron brake rotor.

* * * * *